US007244318B2

(12) United States Patent
Sekino et al.

(10) Patent No.: US 7,244,318 B2
(45) Date of Patent: Jul. 17, 2007

(54) METHOD FOR PREPARATION OF PERMANENT MAGNET

(75) Inventors: Takao Sekino, Osaka (JP); Yuji Kaneko, Uji (JP)

(73) Assignee: Neomax Co., Ltd., Osaka (JP)

( * ) Notice: Subject to any disclaimer, the term of this patent is extended or adjusted under 35 U.S.C. 154(b) by 0 days.

(21) Appl. No.: 10/470,490

(22) PCT Filed: Jan. 22, 2002

(86) PCT No.: PCT/JP02/00442

§ 371 (c)(1),
(2), (4) Date: Jul. 30, 2003

(87) PCT Pub. No.: WO02/061769

PCT Pub. Date: Aug. 8, 2002

(65) Prior Publication Data

US 2004/0050454 A1 Mar. 18, 2004

(30) Foreign Application Priority Data

Jan. 30, 2001 (JP) ..... 2001-021226

(51) Int. Cl.
*H01F 1/057* (2006.01)
*B22F 3/12* (2006.01)

(52) U.S. Cl. ..... 148/101; 148/103; 419/11; 419/12; 419/14

(58) Field of Classification Search ..... 148/101, 148/102, 103, 104; 419/11, 12, 14
See application file for complete search history.

(56) References Cited

U.S. PATENT DOCUMENTS 4,369,075 A * 1/1983 Nobuo et al. ..... 148/102

(Continued)

FOREIGN PATENT DOCUMENTS

EP 0 237 416 9/1987

(Continued)

OTHER PUBLICATIONS

Kianvash et al., "*Densification of a $Nd_{13}Fe_{78}NbCoB_7$-Type Sintered Magnet by (Nd, DY)-Hydride Additions Using a Powder Blending Technique*", Journal of Alloys and Compounds, vol. 287, 1999, pp. 206-214.

(Continued)

*Primary Examiner*—John P. Sheehan
(74) *Attorney, Agent, or Firm*—Nixon Peabody LLP; Jeffrey L. Costellia

(57) ABSTRACT

A blended powder including a first powder containing an $R_2T_{14}B$ phase as a main phase, and a second powder containing an $R_2T_{17}$ phase at 25 wt % or more of the whole is prepared. Herein, R is at least one element selected from the group consisting of all rare-earth elements and Y (yttrium), T is at least one element selected from the group consisting of all transition elements, and Q is at least one element selected from the group consisting of B (boron) and C (carbon). The blended powder is sintered, so as to manufacture a permanent magnet having a structure in which a rare-earth element included in the second powder is concentrated in a grain surgace region of a main phase.

4 Claims, 2 Drawing Sheets

U.S. PATENT DOCUMENTS

| | | | | |
|---|---|---|---|---|
| 4,849,035 | A * | 7/1989 | Stadelmaier et al. | 148/101 |
| 5,387,291 | A * | 2/1995 | Kaneko et al. | 148/101 |
| 5,405,455 | A | 4/1995 | Kusunoki et al. | |
| 5,595,608 | A * | 1/1997 | Takebuchi et al. | 148/104 |
| 6,139,765 | A * | 10/2000 | Kitazawa et al. | 252/62.55 |

FOREIGN PATENT DOCUMENTS

| | | |
|---|---|---|
| JP | 06-096928 | 4/1994 |
| JP | 07-078709 | 3/1995 |
| JP | 07-245206 | 9/1995 |
| JP | 09-283312 | 10/1997 |

OTHER PUBLICATIONS

Ohnashi et al., "*Effects of Rare Earth Oxide Addition on NdFeB Magnets*", J. Magn. Soc. Japan, vol. 11, No. 2, 1987, pp. 235-238 (Japanese language with ABSTRACT).

Velicescu et al., "*Dy-Distribution in the Grains of High-Energy (Nd,Dy)-Fe-B Magnets*", IEEE Transactions on Magnetics, vol. 31, No. 6, Nov. 1995, pp. 3623-3625.

* cited by examiner

METHOD FOR PREPARATION OF PERMANENT MAGNET

TECHNICAL FIELD

The present invention relates to a method of producing a rare-earth-iron-boron based permanent magnet with a high performance, and more particularly to a method of producing a magnet with excellent heat resistance which is used in a rotating machine such as a motor, an actuator, or the like.

BACKGROUND ART

Dysprosium (Dy) is conventionally added to a material alloy for the purposes of improving heat resistance of a rare-earth-iron-boron based (R-T-B) sintered magnet, and of maintaining the coercive force high even in a high temperature condition. The Dy is a kind of rare earth element exhibiting an effect of enhancing an anisotropic magnetic field of $R_2T_{14}B$ phase as a main phase of the R-T-B sintered magnet. The Dy is a rare element. For this reason, if the practical use of electric vehicles is advanced, and the demand for magnets with high heat resistance used in motors for the electric vehicles is increased, an increase in material cost is a matter of concern as a result of tightening of the Dy source. Therefore, the development of technology for reducing the use of Dy in magnets with high coercive force is strongly required.

Conventionally, Dy is added in such a manner that the Dy is blended and melted together with the other elements in material casting. According to such a conventional method, Dy is uniformly distributed in a main phase of a magnet. However, the mechanism for generating the coercive force of the R-T-B sintered magnet is nucleation type, so that, in order to increase the coercive force, it is important to suppress the generation of opposing magnetic domain in the vicinity of the surface of $R_2Fe_{14}B$ crystal grains as a main phase. For this reason, as shown in FIG. 1, if the Dy concentration can be increased in the vicinity of the surface of the main phase ($Nd_2Fe_{14}B$) crystal grains, that is, only in a grain surface region of the main phase, a high coercive force can be realized with a reduced amount of Dy. In FIG. 1, the grain surface region of the main phase in which the Dy concentration is relatively increased is represented as "$(Nd, Dy)_2Fe_{14}B$". In a grain boundary phase, a rare earth rich (R-rich) phase exists.

As methods of reducing the use amount of Dy, thereby obtaining a structure shown in FIG. 1, a method of adding an oxide of Dy (see J. Magn. Soc. Jpn. 11(1987)235), a method of adding a hydride of Dy (see J. Alloys Compd. 287(1999)206), and the like have been proposed, for example.

However, the above-mentioned method of adding the oxide involves a problem that the magnetization is disadvantageously deteriorated as a result of the increase in the amount of oxygen as an impurity. The method of adding the hydride involves a problem that the degree of sintering is deteriorated.

In order to avoid such problems, many suggestions such as the followings are made for structure control by means of multi-alloy method in which a main phase alloy having a composition closer to the stoichiometric composition of $Nd_2Fe_{14}B$ and a liquid-phase alloy of Dy-rich are blended.

(1) Method in which a Dy—Cu alloy is used (Japanese Laid-Open Patent Publication No.6-96928)

(2) Method in which a Dy—Co alloy having a low melting point is used (IEEE Trans. Mag. 31(1995)3623)

(3) Method in which a Dy—Al alloy is used (Japanese Laid-Open Patent Publication No. 62-206802)

(4) Method in which an R-rich R-T-B alloy including B (boron) is used (Japanese Laid-Open Patent Publication No.5-21218)

However, all of the compositions of the Dy alloys used in the above-identified prior arts are rare-earth rich, so that they are easily oxidized during the pulverization or the like. As a result, the amount of oxygen included in the final magnet is increased, so that there exists a problem that the magnetic properties are deteriorated. In addition, since the embrittlement by means of hydrogen occlusion process cannot be efficiently performed for any of the alloys, the degree arid the efficiency of pulverization are bad, and it is difficult to finally obtain fine particles. In addition, in the case where the Dy—Cu alloy or the Dy—Co alloy is used, there exists a problem that the degree of sintering is significantly deteriorated.

A main object of the present invention is to provide a method of suppressing the oxidation of non main-phase alloy, and of improving the ease of pulverization, in a method of producing a permanent magnet obtained by blending a powder of main phase alloy with a powder of non main-phase alloy including a rare-earth element such as Dy which contributes to the improvement of coercive force.

DISCLOSURE OF INVENTION

The method of producing a permanent magnet according to the present invention includes the steps of: preparing a blended powder including a first powder and a second powder, the first powder containing an $R_2T_{14}Q$ phase (R is at least one element selected from the group consisting of all rare-earth elements and Y (yttrium), T is at least one element selected from the group consisting of all transition elements, and Q is at least one element selected from the group consisting of B (boron) and C (carbon)) as a main phase, the second powder containing an $R_2T_{17}$ phase at 25 wt % or more of the whole; and sintering the blended powder.

In a preferred embodiment, a ratio of the second powder to the blended powder is in a range of 1 to 30 wt %.

In a preferred embodiment, the second powder contains Cu in the range of 0.1 to 10 at % (atom %).

In a preferred embodiment, the sintering step includes a step of melting the $R_2T_{17}$ phase contained in the second powder by way of eutectic reaction.

In a preferred embodiment, the first powder is a powder of alloy represented by a composition formula of $R_xT_{100-x-y}Q_y$, and x and y for defining molar fractions satisfy the following relationships, respectively: $12.5 \leqq x \leqq 18$ at %); and $5.5 \leqq y \leqq 20$ (at %).

The second powder may be a powder of alloy represented by a composition formula of $(R1_pR2_q)Cu_rT_{100-p-q-r}$ (R1 is at least one element selected from the group consisting of Dy and Tb, and R2 is at least one element selected from the group consisting of rare-earth elements excluding Dy and Tb, and Y), and p, q, and r for defining molar fractions satisfy the following relationships respectively: $10 \leqq (p+q) \leqq 20$ (at %); $0.2 \leqq p/(p+q) \leqq 1.0$; and $0.1 \leqq r \leqq 10$ (at %).

The method of producing a permanent magnet according to the present invention includes the steps of: preparing a blended powder including a first powder and a second powder, the first powder containing an $R_2T_{14}Q$ phase (R is at least one element selected from the group consisting of all rare-earth elements and Y (yttrium), T is at least one element selected from the group consisting of all transition elements, and Q is at least one element selected from the group consisting of B (boron) and C (carbon)) as a main phase, the second powder being a powder of alloy represented by a composition formula of $(R1_pR2_q)Cu_rT_{100-p-q-r}$ (R1 is at least one element selected from the group consisting of Dy and Tb, and R2 is at least one element selected from the group consisting of rare-earth elements excluding Dy and Tb, and Y); and sintering the blended powder.

The method of producing a permanent magnet according to the present invention includes the steps of: preparing a blended powder including a first powder and a second powder, the first powder containing an $R_2T_{14}Q$ phase (R is at least one element selected from the group consisting of all rare-earth elements and Y (yttrium), T is at least one element selected from the group consisting of all transition elements, and Q is at least one element selected from the group consisting of B (boron) and C (carbon)) as a main phase, the second powder containing an $R_mT_n$ phase (m and n are positive numbers, and satisfy the relationship of $m/n \leqq (1/6)$) at 25 wt % or more of the whole; and sintering the blended powder.

In a preferred embodiment, the $R_mT_n$ phase is an $R_2T_{17}$ phase.

In a preferred embodiment, the step of preparing the blended powder may include a step of performing a hydrogen embrittlement process to the alloy for the second powder, thereby obtaining an average particle diameter of the second powder of 100 μm or less.

An average particle size (FSSS particle size) of the blended powder may be made to be 5 μm or less in a stage before the sintering.

BEST MODE FOR CARRYING OUT THE INVENTION

Figure 1:
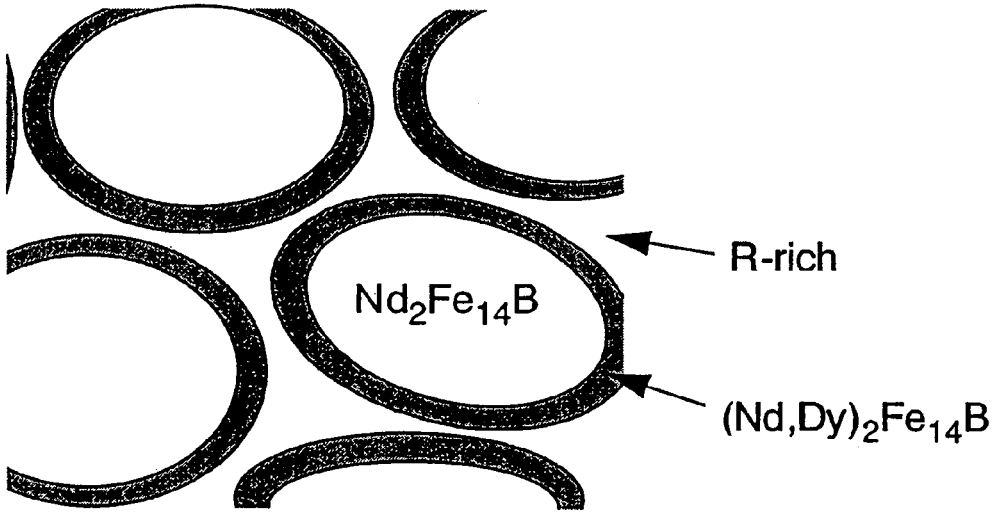
FIG. 1 is a schematic diagram showing a structure, in an R-T-B sintered magnet, in which a Dy concentration in the vicinity of a surface of $R_2Fe_{14}B$ crystal grains as a main phase (in a grain surface region of the main phase) is higher than that of the other portions.

The inventors of the present invention found that to a first powder containing an $R_2T_{14}B$ phase as a main phase, a second powder containing an $R_2T_{17}$ phase including a rare-earth element with a lower molar fraction at 25 wt % or more of the whole was added and mixed, and then they were sintered, so that R in the $R_2T_{17}$ phase could be unevenly distributed in a grain boundary portion of the main phase crystal grains. Herein, R is at least one element selected from the group consisting of all rare-earth elements and yttrium, and T is at least one element selected from the group consisting of all transition elements. Preferably, T includes 50 at % or more Fe, and more preferably, T includes Co in addition to Fe for the purpose of improving the heat resistance.

Carbon (C) may be substituted for part of or all of boron (B), so that the $R_2T_{14}B$ phase can also be represented as $R_2T_{14}Q$ phase (Q is at least one element selected from the group of boron (B) and carbon (C)).

If a rare-earth element such as Dy is included in the $R_2T_{17}$ phase of the second powder as R, the rare-earth element such as Dy can be locally distributed in a grain surface region of a main phase of relatively high concentration, i.e., can be concentrated.

The second powder can be easily obtained by performing hydrogen embrittlement process to a material alloy mainly including $R_2T_{17}$ phase. This is because in a structure in which the $R_2T_{17}$ phase exists together with another phase, the lattice constant of the $R_2T_{17}$ phase is enlarged by hydrogen occlusion, and breakage easily occurs in the grain boundary portion. Such an alloy for the second powder includes a relatively small amount of rare-earth element, as compared with the main phase alloy including the $R_2T_{14}B$ phase. Specifically, the alloy for the second powder is mainly constituted by the $R_2T_{17}$ phase, and the residual portion is constituted by $RT_2$ phase, $RT_3$ phase, $RT_5$ phase, and/or other phases.

If the existent ratio of $R_2T_{17}$ phase in the alloy for the second powder is low, the degree of pulverization of the alloy for the second powder is degraded, and the amount of rare-earth element is relatively increased. As a result, oxidation disadvantageously occurs. Accordingly, the content ratio of the $R_2T_{17}$ phase in the alloy for the second powder is preferably 25 wt % or more, and more preferably 40 wt % or more. Such a material alloy can be prepared by a quenching method such as strip casting, instead of the ingot casting. As for the above-mentioned material alloy, the content of rare-earth element is relatively low as compared with a prior-art liquid phase alloy. For this reason, the material alloy can hardly be oxidized during the pulverization, so that an oxide which badly affects the magnetic properties is hardly generated.

On the other hand, the main phase alloy used in the present invention as the material for the first powder is desired to have a composition of rare earth rich, as compared with the stoichiometric composition of the $R_2Fe_{14}Q$ compound. Because the composition is rare-earth rich, the rare-earth rich phase included in the main phase alloy is reacted with the $R_2T_{17}$ phase of the second powder in sintering, thereby generating a molten liquid. Thus, liquid phase sintering appropriately progresses.

The $R_2T_{17}$ phase dissolves by the reaction with the R-rich phase as described above. If the composition after the blending of powders is short of B (boron), the $R_2T_{17}$ phase is formed again in a cooling process. The $R_2T_{17}$ phase is a soft magnetic phase. For this reason, if the $R_2T_{17}$ phase remains in the sintered magnet, the coercive force is disadvantageously deteriorated. In order to prevent the $R_2T_{17}$ phase from remaining, the composition of the main phase alloy is preferably B rich, as compared with the stoichiometric composition of the $R_2T_{14}B$ compound.

In order to attain the effect of increasing the coercive force, it is preferred that Dy be added to the material alloy for the second powder. Since Tb exhibits the same effects as those of Dy, Tb may be added together with Dy or instead of Dy.

Dy and/or Tb may be added to the material alloy for the first powder. However, in order to effectively attain the object of the present invention of increasing the coercive force while the amount of Dy and/or Tb to be used is reduced, it is preferred that Dy and Tb be not added to the material alloy for the first powder.

The addition of an appropriate amount of Cu to the first powder and/or the second powder, especially to the second powder is preferable, because it is possible to decrease the Dy concentration in the grain boundary phase, and the effect of further increasing the concentration of Dy which is concentrated in the grain surface region of the main phase can be attained. Based on experiments, a preferable range of the Cu content in the second powder is 0.1 to 10 at %.

The element T included in the first powder and the second powder is at least one element selected from the group consisting of all transition elements. Practically, the element T is desired to be selected from the group consisting of Fe, Co, Al, Ni, Mn, Sn, In, and Ga. The element T is preferably formed mainly from Fe and/or Co. For various purposes, other elements are added. For example, Al is added to the material alloy, a superior degree of sintering can be attained even in a relatively lower temperature region (about 800° C.).

The addition of Al to the second powder is preferably performed in a range of not less than 1 at % nor more than 15 at %.

From the above-described view, when the material alloy for the first powder is represented by a composition formula of $R_xT_{100-x-y}Q_y$, x and y for defining molar fractions preferably satisfy the relationships of $12.5 \leqq x \leqq 18$ (at %), and $5.5 \leqq y \leqq 20$ (at %), respectively.

The material alloy for the second powder can be represented by a composition formula of $(R1_pR2_q)Cu_rT_{100-p-q-r}$ (R1 is at least one element selected from the group consisting of Dy and Tb, R2 is at least one element selected from the group consisting of rare-earth elements excluding Dy and Tb, and Y, and T is at least one element selected from the group consisting of all transition elements). According to experiments, p, q, and r for defining molar fractions preferably satisfy the relationships of $10 \leqq (p+q) \leqq 20$ (at %), $0.2 \leqq p/(p+q) \leqq 1.0$, and $0.1 \leqq r \leqq 10$ (at %), respectively.

The material alloy for the second powder is prepared so as to mainly contain the $R_2T_{17}$ phase. Alternatively, the material alloy may contain an $R_mT_n$ phase which includes a relatively small amount of rare-earth element (m and n are positive numbers, and satisfy the relationship of $m/n \leqq (1/6)$) at 25 wt % or more of the whole.

The mixing of the first powder and the second powder prepared by coarsely pulverizing the material alloys having the above-described compositions may be performed before a pulverization process or after the pulverization process. In the case where the mixing of the first powder with the second powder is performed before the pulverization, the pulverization of the alloy for the first powder and the pulverization of the alloy for the second powder are simultaneously performed. On the contrary, the alloy for the first powder and the alloy for the second powder which were coarsely pulverized separately may be further pulverized separately, and then the powders may be mixed at a predetermined ratio. Alternatively, the alloy for the first powder and the alloy for the second powder which are separately pulverized may be merchandized, and they may be mixed at an appropriate ratio. The ratio of the second powder to the whole of the blended powder is preferably set in the range of 1 to 30 wt %.

As for the second powder, before the mixing with the first powder, the material alloy may be coarsely pulverized by hydrogen embrittlement process, and an average particle diameter is preferably 100 μm or less. The alloy for the second powder used in the present invention contains $R_2T_{17}$ phase, so as to have an advantage that the alloy is easily hydrogen-embrittled. In addition, the average particle size (FSSS particle size) of the mixed powder after the first powder and the second powder are mixed is preferably 5 μm or less in a stage before sintering. A more preferable average particle size of the mixed powder is 2 μm or more and 4 μm or less. As compared with the prior art, the alloy for the second powder contains a smaller amount of rare-earth element, so that the oxidation in pulverization is suppressed. As a result, the oxygen concentration in the sintered magnet which is finally obtained can be suppressed to be 8000 ppm or less by weight. More preferably, the oxygen concentration in the sintered magnet is 6000 ppm by weight.

As described above, as for the alloy for the second powder used in the present invention, poor degree of pulverization which is a problem in the case of the liquid phase alloy of rare-earth rich which has been proposed and the activity to the oxygen caused by the high rare-earth composition can be suppressed. In addition, the degree of sintering is superior. As described above, according to the present invention, a magnet with high coercive force can be produced with good productivity.

EXAMPLES

In these examples, alloys A1 to A6 shown in Table 1 are used as material alloys A for the first powder, and alloys B1 to B5 ed as material alloys B for the second powder.

TABLE 1

| | | Alloy Composition (at %) | Blend Ratio (wt %) |
|---|---|---|---|
| Example 1 | Alloy A1 | 14.9Nd-bal.Fe-6.8B | 90 |
| | Alloy B1 | 12.8Dy-bal.Fe-8.0Co-3.5Cu-5.0Al | 10 |
| Example 2 | Alloy A2 | 14.6Nd-bal.Fe-6.8B | 90 |
| | Alloy B2 | 15.5Dy-bal.Fe-8.0Co-3.5Cu-5.0Al | 10 |
| Example 3 | Alloy A3 | 14.5Nd-bal.Fe-7.1B | 85 |
| | Alloy B2 | 15.5Dy-bal.Fe-8.0Co-3.5Cu-5.0Al | 15 |
| Example 4 | Alloy A4 | 14.2Nd-bal.Fe-6.8B | 90 |
| | Alloy B3 | 18.5Dy-bal.Fe-8.0Co-3.5Cu-5.0Al | 10 |
| Comp. 1 | Alloy A5 | 13.9Nd-balFe-6.8B | 90 |
| | Alloy B4 | 21.8Dy-bal.Fe-8.0Co-3.5Cu-5.0Al | 10 |
| Comp. 2 | Alloy A6 | 13.5Nd-bal.Fe-6.8B | 90 |
| | Alloy B5 | 25.4Dy-bal.Fe-8.0Co-3.5Cu-5.0Al | 10 |

Figure 2:
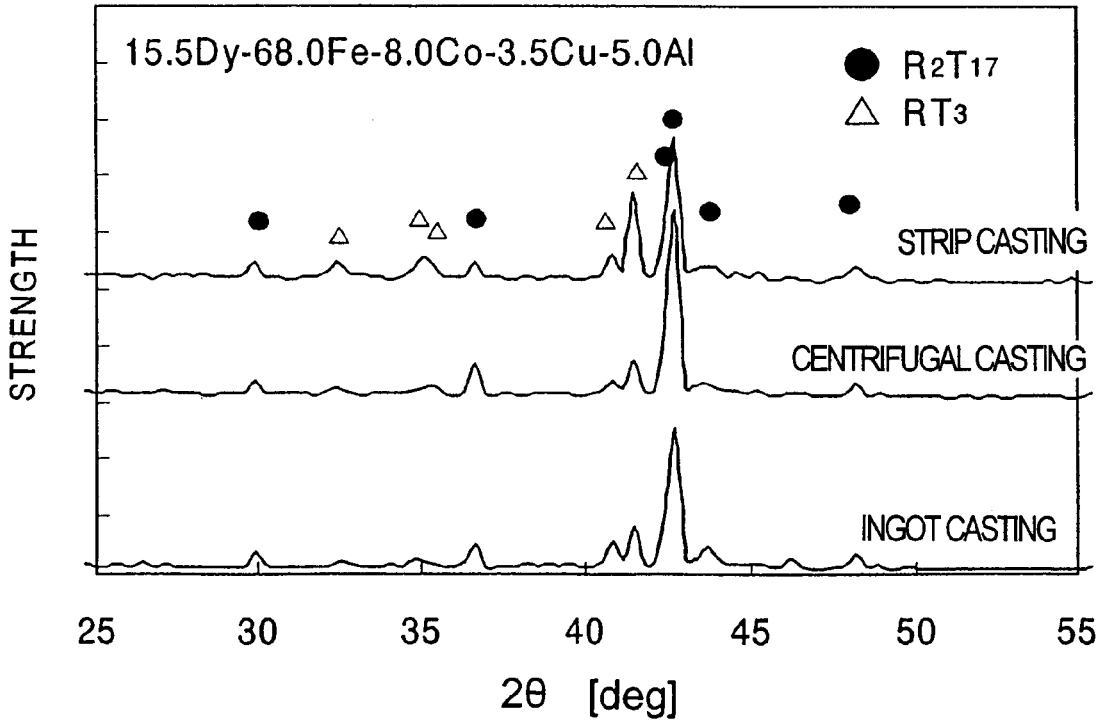
FIG. 2 is a graph showing X-ray diffraction patterns of alloys B2 cast by three types of casting methods, i.e., strip casting, centrifugal casting, and ingot casting.

In order to investigate the variation in constituent phase of the material alloys B caused by the difference of casting methods, the alloy B2 containing 15.5 at % Dy was cast by using three methods, i.e., strip casting, centrifugal casting, and ingot casting, and the constituent phases were examined. The results are shown in FIG. 2. In FIG. 2, the symbol ● and the symbol Δ indicate the diffraction peaks of the $R_2T_{17}$ phase and the $RT_3$ phase, respectively.

As is seen from FIG. 2, even if the casting methods are different, there occurs not so large difference in the structures of the crystalline phase for the same material composition. Therefore, in the examples of the present invention (and in the comparative examples) described below, the alloys were prepared by the ingot casting as representative, and used.

Figure 3:
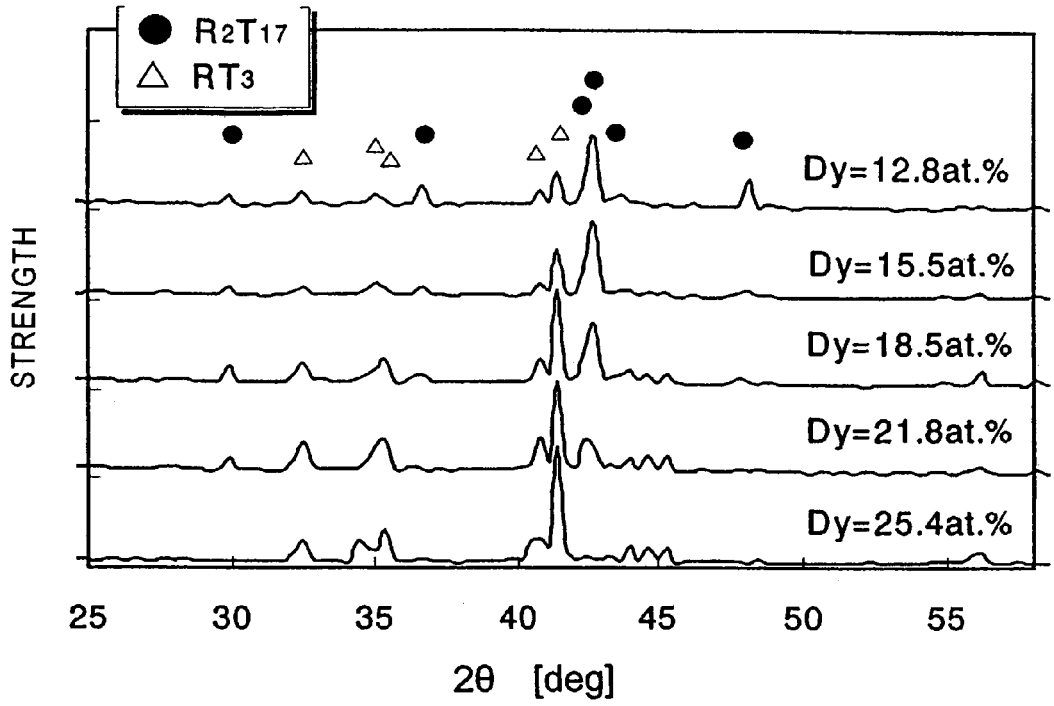
FIG. 3 is a graph showing X-ray diffraction patterns of alloys B1 to B5, and showing how constituent phases are affected when the contents of rare-earth elements in the alloys B1 to B5 are varied.

In order to investigate how the constituent phase of the alloy B was affected when the content of rare-earth element in the alloy B was varied, X-ray diffraction measurement was performed for the alloys B1 to B5 with different contents of rare-earth elements. The results are shown in FIG. 3. As is seen from FIG. 3, in the case where the amount of Dy in the alloy B is relatively small, the constituent phase is mainly an $R_2T_{17}$ phase and an $RT_3$ phase. As the amount of Dy increases, the existent ratio of the $R_2T_{17}$ phase is reduced. More specifically, in the case of the alloy B4 (Dy=21.8 at %), the existent ratio of the $R_2T_{17}$ phase was very low. In the case of the alloy B5 (Dy=25.4 at %), the existence of the $R_2T_{17}$ phase could not be recognized.

From the above-described results, it is understood that the upper limit of the preferable range of the amount of Dy (the amount of rare-earth element) in the alloy B is 20 at % or less. When the amount of Dy (the amount of rare-earth element) in the alloy B is smaller than 10 at %, the magnetic properties are deteriorated. Therefore, the amount of Dy (the amount of rare-earth element) in the alloy B is preferably 10 at % or more and 20 at % or less.

Hereinafter, the production methods of the examples and the comparative examples will be described.

First, the hydrogen occlusion and dehydrogenation processes were performed for the respective alloys A and B having the compositions shown in Table 1, thereby performing coarse pulverization (hydrogen embrittlement process). In the alloy B4 and the alloy B5 containing a large amount of Dy, the degree of pulverization by the hydrogen process was poor. For this reason, after the hydrogen embrittlement treatment process, mechanical pulverization was performed, until the particle diameter became 420 μm or less by using a stamp mill.

Next, after the alloy A and the alloy B were mixed at a blend ratios shown in respective boxes of Examples 1 to 4 and Comparative Examples 1 to 2 in Table 1, pulverization was performed by using a jet mill of $N_2$ gas atmosphere. An average particle size (FSSS particle size) of the blended powder after the pulverization was about 3 to 3.5 μm. The variation in Dy amount before and after the pulverization is shown in Table 2.

TABLE 2

| | Dy amount in Alloy B (at %) | Blend ratio of Alloy B (wt %) | Dy composition (at %) Before Pluverization | Dy composition (at %) After Pluverization | Dy (%) |
|---|---|---|---|---|---|
| Example 1 | 12.8 | 10 | 1.28 | 1.27 | 99.2 |
| Example 2 | 15.5 | 10 | 1.55 | 1.54 | 99.0 |
| Example 3 | 15.5 | 15 | 2.32 | 2.30 | 99.1 |
| Example 4 | 18.5 | 10 | 1.85 | 1.81 | 97.8 |
| Comp. 1 | 21.8 | 10 | 2.18 | 2.02 | 92.7 |
| Comp. 2 | 25.4 | 10 | 2.54 | 2.21 | 87.0 |

The "remaining proportion" in the most right column in Table 2 is an amount indicated by (Dy amount after pulverization/Dy amount before pulverization)×100. A larger amount indicates superior degree of pulverization of the alloy B. As is seen from Table 2, in the comparative examples 1 and 2, the degree of pulverization of the alloy B is poor.

Figure 4A:
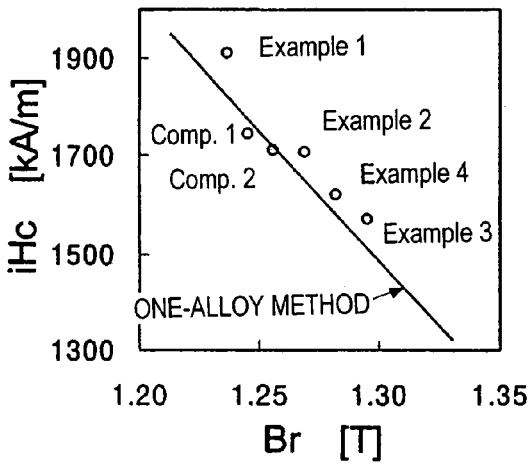
FIG. 4A is a graph showing residual magnetic flux densities Br (unit: T (tesra)), and coercive forces iHc (unit: $kAm^{-1}$) of Examples and Comparative Examples.
Figure 4B:
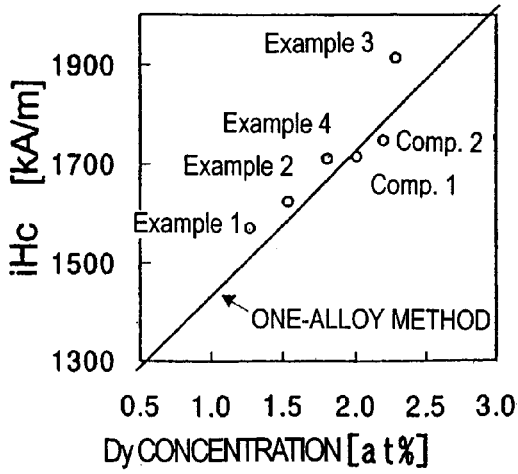
FIG. 4B is a graph showing the dependency on Dy concentration (unit: at %) of the coercive force iHc.

Next, after a compaction process in an aligned magnetic field was performed by using the thus-obtained fine powder, a sintering process was performed, thereby manufacturing a permanent magnet. Evaluated results of magnetic properties of the magnet are shown in Table 3, and FIGS. 4A and 4B.

TABLE 3

| | Dy Amount in Magnet (at %) | Density ($10^3$ kg/m$^3$) | $B_r$ (T) | $(BH)_{max}$ (kJ/m3) | $H_{cJ}$ (kA/m) |
|---|---|---|---|---|---|
| Example 1 | 1.27 | 7.59 | 1.295 | 324.6 | 1570 |
| Example 2 | 1.54 | 7.59 | 1.282 | 318.4 | 1620 |
| Example 3 | 2.30 | 7.62 | 1.237 | 296.9 | 1910 |
| Example 4 | 1.81 | 7.61 | 1.269 | 312.3 | 1705 |
| Comp. 1 | 2.02 | 7.59 | 1.256 | 306.1 | 1712 |
| Comp. 2 | 2.21 | 7.60 | 1.246 | 301.2 | 1742 |

From the results, in the cases of Examples 1 to 4, it is seen that a high coercive force can be obtained with a smaller Dy amount, as compared with a one-alloy method. In addition, in Comparative Examples 1 to 2, even though the Dy amount in the alloy B is large, the effect of increasing a coercive force caused by the addition of Dy is not observed. Moreover, since the Dy remaining proportion in pulverization is low, Dy is wastefully used, and the Dy reducing effect cannot be sufficiently attained.

INDUSTRIAL APPLICABILITY

According to the present invention, two kinds of alloy powders with excellent degree of pulverization and oxidation resistance are appropriately mixed, so that a structure in which the concentration of a specific rare-earth element such as Dy in a grain surface region of a main phase is made higher than that of the other portions can be produced with good production yield. Accordingly, as compared with a method in which Dy is added at the point of melting the material alloy and Dy is uniformly diffused, the present invention can inexpensively produce a sintered magnet exhibiting high coercive force with a reduced amount of Dy with good productivity. In addition, according to the present invention, Dy can be efficiently concentrated in a grain surface region of a main phase, so that the saturation magnetization in the main phase inner portion of the sintered magnet is maintained to be high, and the reduction in residual magnetic flux density Br due to the addition of Dy can be suppressed.

The invention claimed is:

1. A method of producing a sintered permanent magnet comprising the steps of:

preparing a blended powder including a first powder and a second powder, the first powder containing an $R_2T_{14}Q$ phase (R is at least one element selected from the group consisting of all rare-earth elements and Y (yttrium) excluding Dy and Tb, T is at least one element selected from the group consisting of all transition elements, and Q is at least one element selected from the group consisting of B (boron) and C (carbon)) as a main phase, the second powder containing an $R1_2T_{17}$ phase (R1 is at least one element selected from the group consisting of Dy and Tb) at 25wt % or more of the second powder;

compacting the blended powder; and sintering the compacted powder to concentrate Dy and/or Tb in a surface portion of the $R_2T_{14}Q$ phase, wherein the first powder is a powder of alloy represented by a composition formula of $R_xT_{100-x-y}Q_y$, and x and y for defining molar fractions satisfy the following relationships, respectively:

$12.5 \leqq x \leqq 18$(at %); and $5.5 \leqq y \leqq 20$ (at %), and the second powder is a powder of alloy represented by a composition formula of $R1_pCu_rT_{100-p-r}$, and p and r for defining molar fractions satisfy the following relationships respectively:

$10 \leqq p \leqq 20$(at %); and $0.1 \leqq r \leqq 10$(at %), and wherein the step of preparing the blended powder includes a step of performing a hydrogen embrittlement process to the alloy for the second powder, thereby obtaining an average particle diameter of the second powder of 100 μm or less.

2. The method of producing a sintered permanent magnet according to claim 1, wherein a ratio of the second powder to the blended powder is in a range of 1 to 30wt %.

3. The method of producing a sintered permanent magnet of claim 1, wherein the sintering step includes a step of melting the $R_2T_{17}$ phase contained in the second powder by way of eutectic reaction.

4. The method of producing a sintered permanent magnet of any of claims 1, 2, or 3, wherein an average particle size (FSSS particle size) of the blended powder is made to be 5 μm or less in a stage before the sintering.

* * * * *